US006066023A

United States Patent [19]

Chen

[11] Patent Number: 6,066,023

[45] Date of Patent: May 23, 2000

[54] YO-YO WITH LASER EMISSION MEANS

[75] Inventor: Sean Chen, Taipei, Taiwan

[73] Assignee: Sean & Stephen Corporation, Taiwan

[21] Appl. No.: 09/246,565

[22] Filed: Feb. 8, 1999

[51] Int. Cl.[7] ..... A63H 1/30

[52] U.S. Cl. ..... 446/242; 446/250; 446/251

[58] Field of Search ..... 446/242, 250, 446/251, 252, 253, 254; D21/463, 464

[56] References Cited

U.S. PATENT DOCUMENTS

| | | | |
|---|---|---|---|
| 3,162,979 | 12/1964 | Garoogian | 446/250 |
| 3,191,344 | 6/1965 | Yagjian | 446/242 |
| 3,971,158 | 7/1976 | Hanson | 446/242 |
| 4,327,518 | 5/1982 | Knauff | 446/251 |
| 4,867,727 | 9/1989 | Lanius | 446/250 |
| 5,356,328 | 10/1994 | Ho | 446/250 |

FOREIGN PATENT DOCUMENTS

| | | | |
|---|---|---|---|
| 1032320 | 6/1966 | United Kingdom | 446/250 |

*Primary Examiner*—Sam Rimell
*Assistant Examiner*—Jeffrey D. Carlson
*Attorney, Agent, or Firm*—Smith Gambrell & Russell, LLP

[57] ABSTRACT

A yo-yo with laser emission means mainly includes two side covers each defining a hollow space for accommodating a middle disc therein. The middle discs are provided at their outward-facing surfaces each with a seat for separately receiving a laser emission means and a light-emitting means therein, and a battery room for accommodating serially connected batteries. The laser emission means and the light-emitting means have terminals led to the batteries. When the yo-yo is manipulated by a player to rotate at a high speed, the terminals of the laser emission means and the light-emitting means contact with electrodes of the batteries due to centrifugal force and are energized by the batteries to emit laser beams and lights, respectively. The laser beams continuously project from an opening provided on the side cover and toward different directions and the lights illuminate the yo-yo, making the yo-yo particularly distinctive in the night or at a dark place.

7 Claims, 5 Drawing Sheets

FIG. 3A
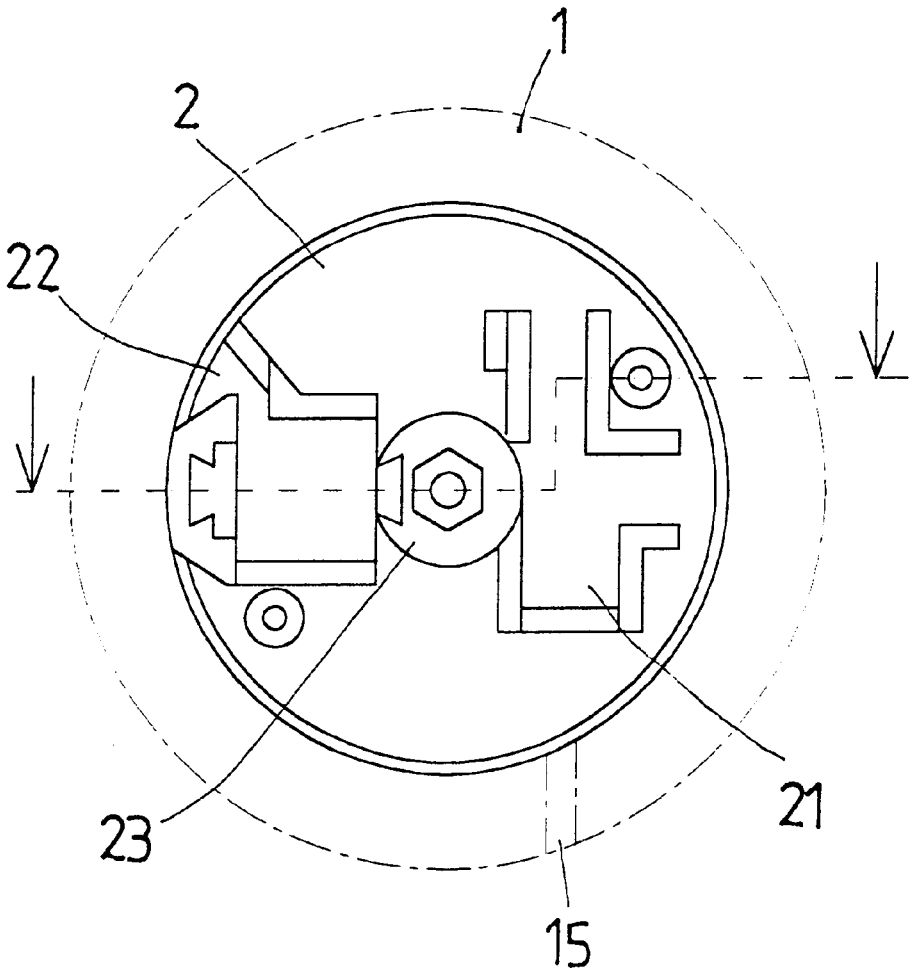
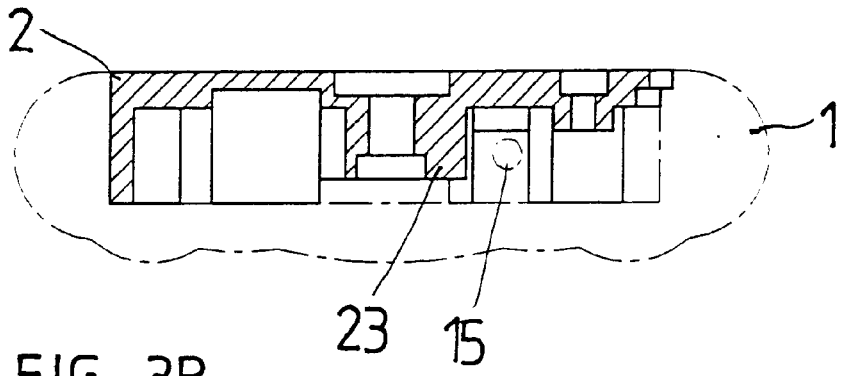
FIG 3B

YO-YO WITH LASER EMISSION MEANS

FIELD OF THE INVENTION

The present invention relates to a yo-yo with laser emission means, and more particularly to a yo-yo with laser emission means and having enhanced impact strength to resist breakage. A whistle may be mounted on the yo-yo to sound when the yo-yo rotates at high speed while moving to and fro linearly.

BACKGROUND OF THE INVENTION

Yo-yo is a popular toy that attracts both children and adults. There are many designs about yo-yo disclosed in prior inventions, such as that named as "Kong-Fu Yo-yo" published in Taiwan under Publication No. 334830. The Kong-Fu Yo-yo includes a rotary that is rotated by manipulating a string wound about the yo-yo. When the rotary rotates, steel balls at two sides of a supporting lever inside the rotary move upward. By utilizing a stress corresponding to the floating steel balls, a shaft of the rotary is allowed to rotate about a bolt. With a restoring spring and a balancing spring provided in the rotary, the supporting lever could automatically restore to a balanced position. These arrangements allow the Kong-Fu Yo-yo to be more easily manipulated to rotate smoothly. The rotary of the Kong-Fu Yo-yo is closed between two side covers. However, the side covers of the Kong-Fu Yo-yo tend to break, separate apart or even be destroyed when the yo-yo collides with a hard ground or wall while being played.

In addition to the disadvantage of being subject to breakage, most of the yo-yos currently available in the markets have similar internal structure and external appearance, making yo-yos not so attractive to consumers as before.

It is therefore desirable to develop a yo-yo having high impact strength and distinctive appearance and being provided with laser emission means and whistles to create more funs for a prolonged period of time.

SUMMARY OF THE INVENTION

A primary object of the present invention is to provide a yo-yo with laser emission means that employs centrifugal force to cause batteries in the rotating yo-yo to contact with terminals of and supply current to the laser emission means for the same to continuously emit laser beams, making the yo-yo more interesting for play.

Another object of the present invention is to provide a yo-yo with laser emission means that includes two side covers provided at outer surfaces with a larger convex portion and a plurality smaller convex portions around the larger convex portion. These convex portions form beautiful and smoothly curved lines on the side covers and give the side covers enhanced impact strength against breakage caused by collision of the rotating yo-yo with external hard ground, wall or object.

A further object of the present invention is to provide a yo-yo with laser emission means that further includes a light-emitting means mounted between the side covers. The light-emitting means is supplied with current from the batteries to continuously emit lights when the yo-yo is rotating, making the yo-yo particularly distinctive in the night or at a dark place.

A still further object of the present invention is to provide a yo-yo with laser emission means that includes a whistle mounted in a through hole formed on a side cover of the yo-yo. When the yo-yo is rotating, air passes through the through hole and causes the whistle to sound that creates more funs in playing the yo-yo.

BRIEF DESCRIPTION OF THE DRAWINGS

The structural features and the operation of the present invention can be best understood by referring to the following detailed description of the preferred embodiments and the accompanying drawings, wherein

FIG. 3A is a sectional view of the yo-yo of FIG. 1;

FIG. 3B is a fragmentary cross section taken on the broken line of FIG. 3A;

DETAILED DESCRIPTION OF THE PREFERRED EMBODIMENTS

Figure 1:
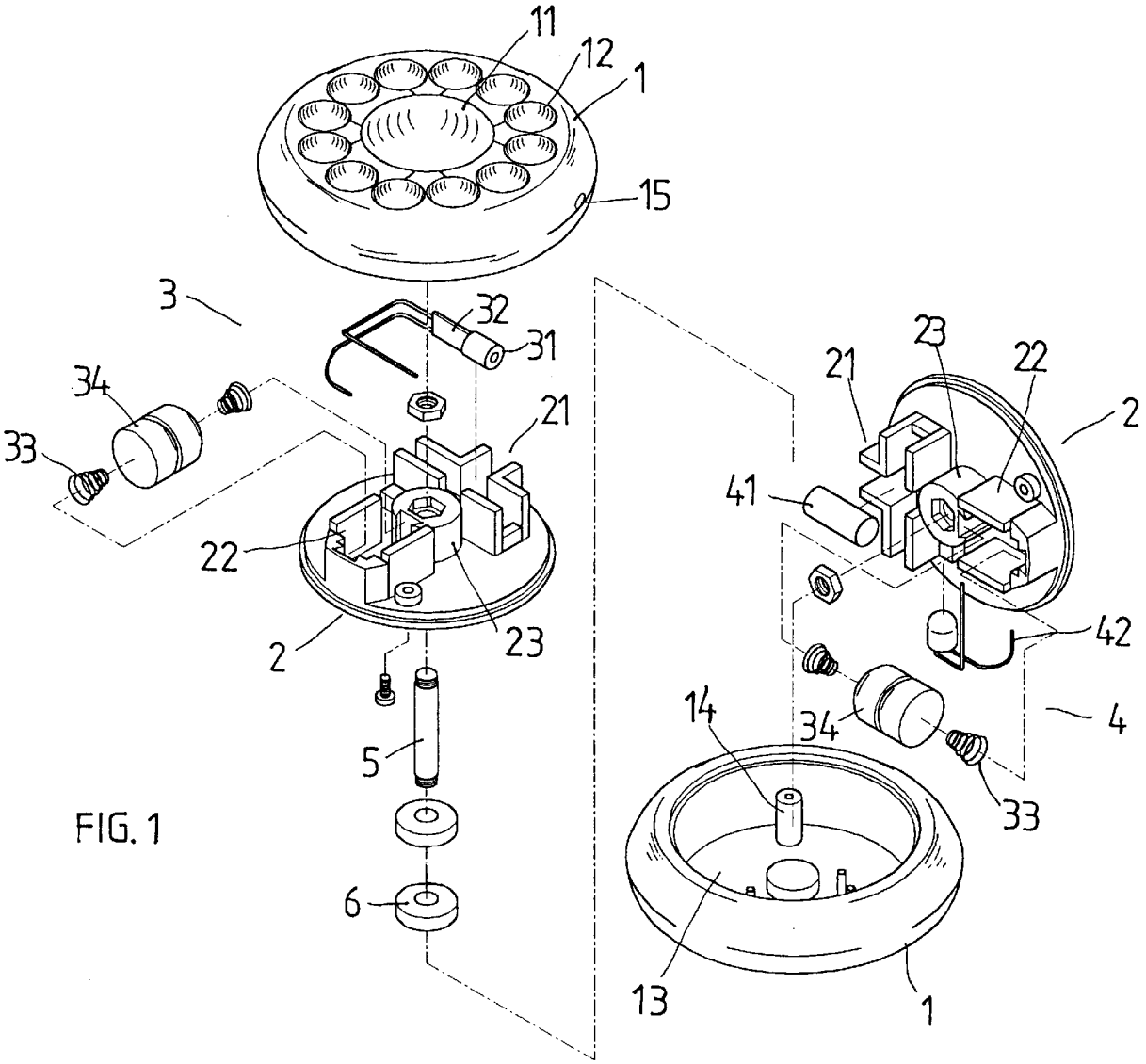
FIG. 1 is an exploded perspective of a yo-yo with laser emission means according to the present invention.
Figure 2:
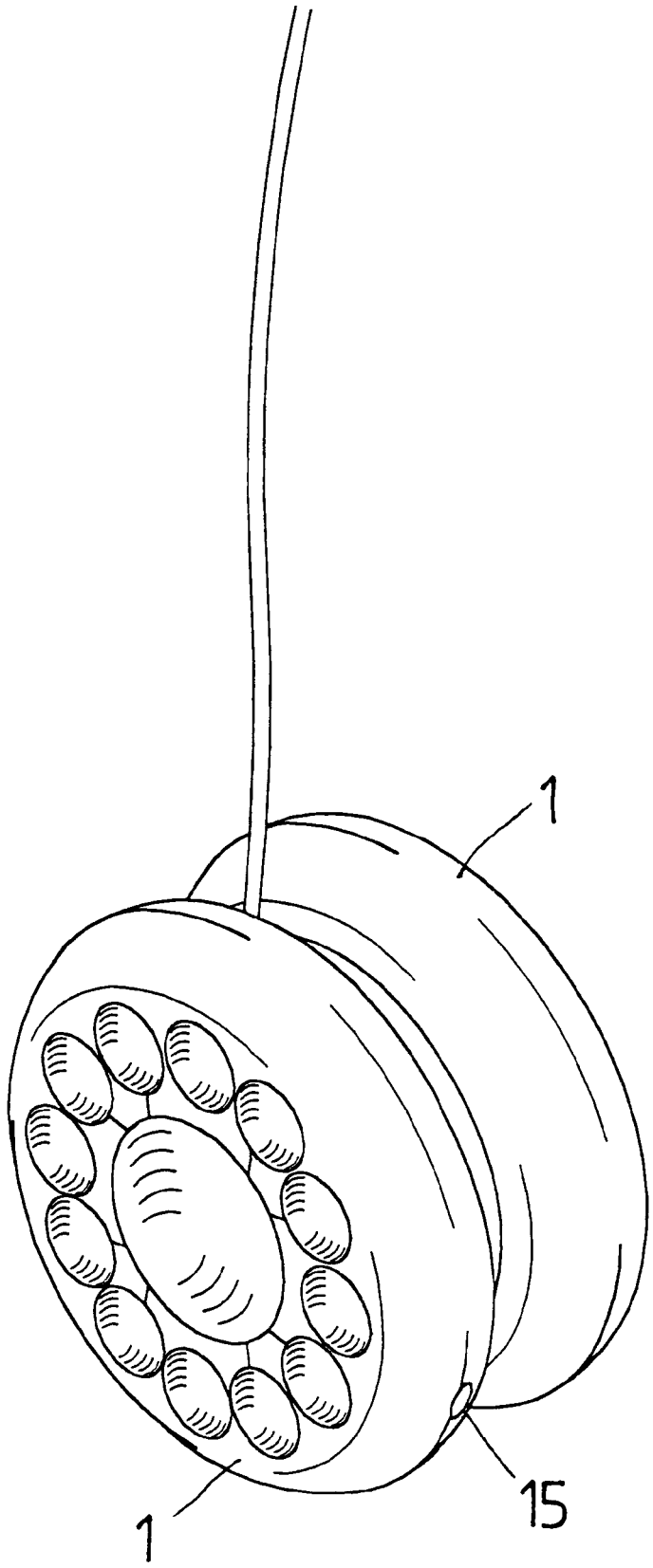
FIG. 2 is an assembled perspective of the yo-yo of FIG. 1.

Please refer to FIGS. 1 and 2 that are exploded and assembled perspective views, respectively, of a yo-yo with laser emission means according to the present invention. As shown, the yo-yo mainly includes two side covers 1, two middle discs 2, a laser emission means 3, and a light-emitting means 4.

The side covers 1 are structurally symmetrical and preferably made of clear or translucent material to define a sideward opened circular hollow space 13. An outer surface of each side cover 1 is formed of a larger convex portion 11 and a plurality of smaller convex portions 12 around the larger convex portion 11, creating smooth and curved lines on the side cover 1 that not only beautify the yo-yo but also give the side covers of the yo-yo enhanced impact strength. There is more than one internally threaded rod 14 in each hollow space 14 perpendicularly projected from an inner surface of the side cover 1. Screws may be screwed into the rods 14 to fasten of the middle discs 2 to the side covers 1. What is to be noted is one of the two side covers 1 is provided at a predetermined position with a laser beam projecting opening 15.

The middle discs 2 are structurally symmetrical and have a diameter the same as that of the hollow spaces 13 defined by the side covers 1, such that the middle discs 2 can be mounted in the hollow spaces 13. Each of the middle discs 2 is provided on a surface facing outward with a generally cross-shaped seat 21, a battery room 22, and a connecting seat 23 that is preferably located between the seat 21 and the battery room 22.

The laser emission means 3 includes a laser emitter 31 connected to a circuit board 32 and is disposed in the cross-shaped seat 21 on one of the middle discs 2. The battery room 22 on the same middle disc 2 has batteries 34 serially mounted therein and two springs 33 separately disposed between two electrodes of the batteries 34 and the battery room 22 to electrically connect the batteries 34 to two terminals of the laser emitter 31, so that the batteries 34 continuously supply current to the laser emitter 31.

The light-emitting means 4 includes a cylindrical weight 41 and a light-emitting diode 42 having two terminals. The weight 41 and the light-emitting diode 42 are disposed in the cross-shaped seat 21 on the other middle disc 2 with the two terminals of the light-emitting diode 42 led to two electrodes of the batteries 34 disposed in the battery room 22 on the same one middle disc 2. Similarly, two springs 33 are positioned between two outer ends of the batteries 34 and the battery room 22. Thereby, current may be continuously supplied from the batteries 34 to the light-emitting diode 42 via the two terminals.

The two middle discs 2 having the springs 33, the batteries 34, the laser emission means 3, and the light-emitting means 4 mounted thereon are connected together at their another surface by extending a spindle 5 having two externally threaded ends through the connecting seats 23 and tightly fixing the middle discs 2 around the spindle 5 by screwing nuts to the threaded ends of the spindle 5 projected from the connecting seats 23. To allow the two middle discs 2 to stably and firmly mount in the hollow spaces 13 in the side covers 1 without being easily moved, two cushions 6 are disposed between the two middle discs 2 to prevent the middle discs 2 from loosely moving in the hollow spaces 13.

FIG. 3A is a sectional view of the above described yo-yo of the present invention and FIG. 3B is a fragmentary cross section taken on the broken line of FIG. 3A to show the relative positions of the above-mentioned components in the assembled yo-yo.

Figure 4:
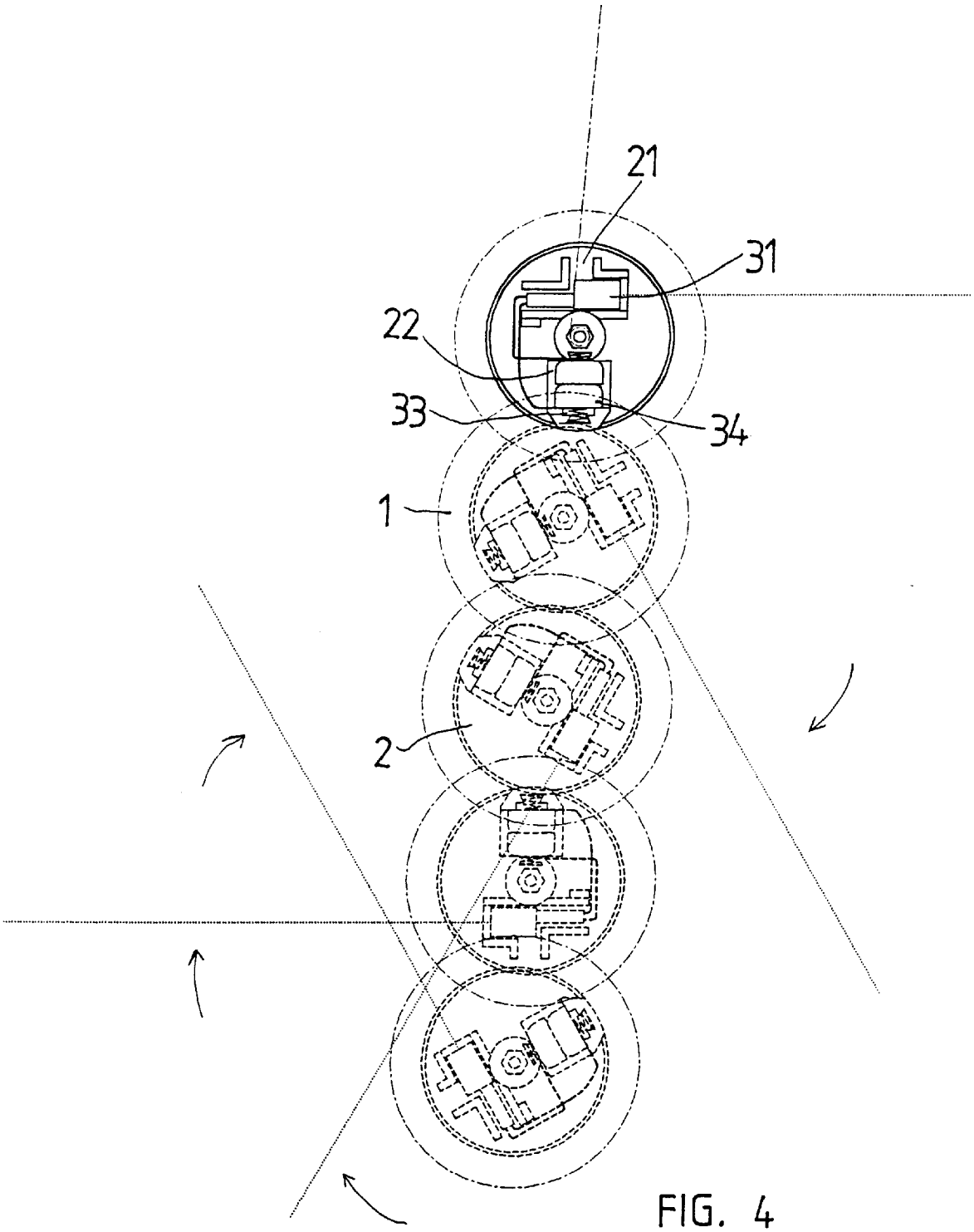
FIG. 4 shows the emission of laser beam from a yo-yo of the present invention in moving state.

Please now refer to FIG. 4. When the yo-yo with laser emission means according to the present invention is manipulated by a player to rotate along a string to and fro at a very quick speed, the batteries 34 mounted in the battery rooms 22 of the middle discs 2 tightly press against the springs 33 due to a centrifugal force. At this point, the batteries 34 on the middle disc 2 that has the laser emission means 3 mounted thereto continuously supply current to the terminals of the laser emitter 31 via the springs 33, causing the laser emitter 31 to continuously project a laser beam through the laser beam projecting opening 15 formed on the side cover 1. When the yo-yo quickly rotates and moves to and fro, the laser beam projects toward different directions and would always interestingly attract any player and viewer. Meanwhile, batteries 34 mounted in the battery room 22 of the other middle disc 2 having the light-emitting means 4 mounted thereto similarly supply continuous current to the light-emitting diode 42 via the terminals led to the springs 33, causing the light-emitting diode 42 to continuously emit light and illuminate the yo-yo. An illuminated yo-yo played in the night or at a dark place is more attractive and creates more funs. It is possible to have the light-emitting diode 42 to emit lights of different colors to create different feeling or atmosphere.

Figure 5:
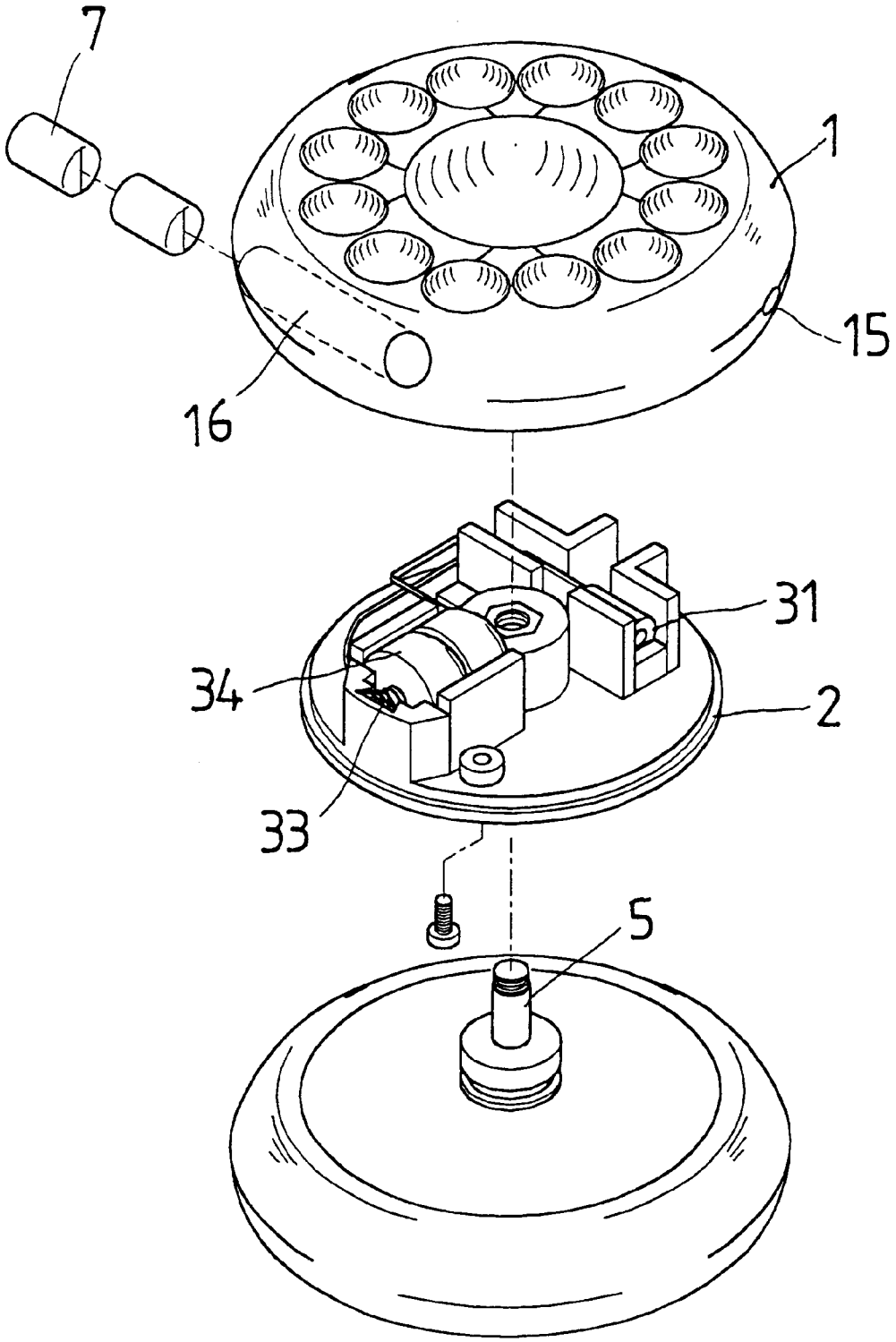
FIG. 5 is an exploded perspective of a yo-yo with laser emission means according to another embodiment of the present invention.

FIG. 5 illustrates another embodiment of the present invention. In this embodiment, one or two of the side covers 1 are provided with a through hole 16 that forms two spaced openings on the side cover 1. A whistle 7 is mounted in each through hole 16, such that when the yo-yo is rotating while moving to and fro linearly, the whistle 7 in each through hole 16 would sound when air passes through the hole 16. The yo-yo with whistles 7 is therefore more interesting for play.

With the above arrangements, the yo-yo having laser emission means according to the present invention has enhanced impact strength and is not subject to breakage and is therefore durable for use. Moreover, the yo-yo of the present invention has specially designed appearance that is beautiful and attractive while the laser emission means and the whistles make the yo-yo more interesting for play.

What is to be noted is the present invention described above is to be taken as a preferred embodiment of the invention and that various changes in the arrangements may be resorted to without departing from the spirit of the invention or the scope of the subjoined claims.

What is claimed is:

1. A yo-yo with laser emission means, comprising:

two side covers each defining a sideward opened hollow space, said hollow space each having more than one perpendicularly projected rod for receiving fastening means to assemble said yo-yo, and at least one of said two side covers being provided at a predetermined position with a laser beam projecting opening; and two middle discs separately mounted in said hollow spaces defined by said side covers by screwing said fastening means through said middle discs into said perpendicularly projected rods in said side covers, said middle disc each being provided at one surface with a receiving seat, a battery room, and a connecting seat located between said receiving seat and said battery room, at least one of said receiving seats on said middle discs being used to receive a laser emitter and a circuit board connected to said laser emitter for projecting a laser beam through said laser beam projecting opening formed on said side cover, said battery rooms being used to each accommodate two springs and batteries serially disposed between the two springs for supplying current to said laser emitter via said springs, and said connecting seats having a spindle extended therethrough with fastening means screwed to two externally threaded ends of said spindle to tightly connect said two middle discs together.

2. A yo-yo with laser emission means as claimed in claim 1, wherein said side covers can be made of either clear or translucent material.

3. A yo-yo with laser emission means as claimed in claim 2, wherein each of said two side covers is provided at an outer surface with a larger convex portion and a plurality of smaller convex portions around said larger convex portion, said convex portions providing smoothly curved lines on said side covers to give said side covers enhanced impact strength to resist possible breakage.

4. A yo-yo with laser emission means as claimed in claim 2, wherein at least one of said two side covers is provided at a predetermined position with a through hole for a whistle to mount therein, whereby when air passes through said whistle in said through hole while said yo-yo is manipulated by a player to rotate, said whistle sounds to create more funs.

5. A yo-yo with laser emission means as claimed in claim 1, wherein said middle discs are firmly and stably mounted between said two side covers without being easily moved in said hollow spaces by disposing two cushions around said spindle and between said two middle discs.

6. A yo-yo with laser emission means as claimed in claim 1, wherein said receiving seat on one of said two middle discs is used to receive a weight and a light-emitting diode, said light-emitting diode having two terminals connected to said batteries mounted in said battery room on the same said middle disc, whereby when said yo-yo is manipulated by a player to rotate, said light-emitting diode is supplied with current from said batteries to continuously emit lights that make said yo-yo particularly distinctive in the night or at a dark place.

7. A yo-yo with laser emission means as claimed in claim 3, wherein at least one of said two side covers is provided at a predetermined position with a through hole for a whistle to mount therein, whereby when air passes through said whistle in said through hole while said yo-yo is manipulated by a player to rotate, said whistle sounds to create more funs.

* * * * *